US005431838A

United States Patent [19]

Carr et al.

[11] Patent Number: 5,431,838

[45] Date of Patent: Jul. 11, 1995

[54] CARBONATE BUILT LAUNDRY DETERGENT COMPOSITION CONTAINING A STRONTIUM SALT

[75] Inventors: Charles D. Carr, Yardley, Pa.; Joseph G. Becker, Martinsville, N.J.

[73] Assignee: Church & Dwight Co., Inc., Princeton, N.J.

[21] Appl. No.: 169,772

[22] Filed: Dec. 17, 1993

[51] Int. Cl.[6] ..... C10D 3/10; C10D 3/06; C10D 3/37

[52] U.S. Cl. ..... 252/174.14; 252/133; 252/174.21; 252/173; 252/549; 252/550; 252/554; 252/DIG. 14

[58] Field of Search ..... 252/549, 550, 554, 174.21, 252/173, DIG. 14, 174.14, 133

[56] References Cited

U.S. PATENT DOCUMENTS

| | | | |
|---|---|---|---|
| 3,686,098 | 8/1972 | Weil | 252/550 |
| 3,850,854 | 11/1974 | Weil | 252/551 |
| 3,998,750 | 12/1976 | Payna et al. | 252/108 |
| 4,265,790 | 5/1981 | Winston et al. | 252/532 |
| 4,464,292 | 8/1984 | Lengyel | 252/532 |
| 4,490,271 | 12/1984 | Spadini et al. | 252/174.23 |
| 4,521,332 | 6/1985 | Milora | 252/527 |
| 4,711,740 | 12/1987 | Carter et al. | 252/174.24 |
| 4,756,846 | 7/1988 | Matsuura et al. | 252/156 |
| 4,820,441 | 4/1989 | Evans et al. | 252/174.18 |
| 4,849,125 | 5/1989 | Seiter et al. | 252/109 |
| 5,376,300 | 12/1994 | Bolkan et al. | 252/174.14 |

OTHER PUBLICATIONS

M. E. McLester et al., "Effects of Alkaline Earth Metal Ions on the Transformation of Aragonite to Calcite in Agneaus Solution", Journal of Inorganic Nuclear Chemistry 32(1970) 391-399.

*Primary Examiner*—Paul Lieberman
*Assistant Examiner*—Nicholas Ogden
*Attorney, Agent, or Firm*—Charles B. Barris

[57] ABSTRACT

A laundry detergent composition, wherein the solids content comprises an active surfactant, at least about 70 wt. % of a water soluble alkaline carbonate, e.g., sodium carbonate, a minor amount of elemental strontium in the form of a water soluble salt, e.g., strontium chloride, and, optionally, a minor amount of a polymer polycarboxylate, e.g., an acrylic acid polymer, based on the total weight of solids in the composition. Incorporation of strontium ions in the foregoing laundry detergent composition containing carbonate ions is intended to minimize negative interactions that will occur between the precipitation of calcium carbonate and the surfaces of the fabric being cleaned, e.g., fabric encrustation, with an enhancement of this effect when polymeric polycarboxylate is present.

14 Claims, No Drawings

CARBONATE BUILT LAUNDRY DETERGENT COMPOSITION CONTAINING A STRONTIUM SALT

BACKGROUND OF THE INVENTION

1. Field of the invention

This invention relates to novel laundry detergent compositions having a high water-soluble alkaline carbonate builder content, the use of which results in reduced fabric encrustation.

2. Information Disclosure Statement Including Description of Related Art

The following information is being disclosed under the provisions of 37 CER 1.56, 1.97 and 1.98.

Laundry detergent compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active surfactant, such as its stabilization of solid soil suspensions, solubilization of water-insoluble materials, emulsification of soil particles, and foaming and sudsing characteristics. Other mechanisms by which builders improve the cleaning power of detergent compositions are probably present but are less well understood. Builders are important not only for their effect in improving the cleaning ability of active surfactants in detergent compositions, but also because they allow for a reduction in the amount of the surfactant used in the composition, the surfactant being generally much more costly than the builder.

Two important classes of builders have been widely used in recent years, viz., phosphorus containing salts such as sodium tripolyphosphate (STPP) which are very effective in sequestering calcium and magnesium ions without precipitating them, and the water-soluble alkaline carbonates mentioned previously such as sodium carbonates which may be used in amounts up to 90 wt. % of the composition and which effectively precipitate the calcium ions. However, phosphorus-containing builders have been found to cause a serious problem of eutrophication of lakes, rivers and streams when present in detergent compositions in relatively large amounts, resulting in the passage of laws in several states mandating a drastic reduction in their use. While the use of water-soluble alkaline carbonate builders do not cause eutrophication, they result in the unrelated problem of calcium carbonate precipitation, leading to, for example, fabric encrustation due to the deposition of the calcium carbonate on the fiber surfaces of fabrics which in turn causes fabric to have a stiff hand and gives colored fabrics a faded appearance.

Polymeric polycarboxylates such as polyacrylates are also known in the detergent art as effective sequestering and dispersing agents as well as crystal growth inhibitors. However, such polycarboxylates have limited biodegradability which presents an environmental problem if they are used in relatively large amounts.

The following prior art references may be considered relevant or material to the invention claimed herein.

U.S. Pat. Nos. 4,265,790, issued May 5, 1981 to Winston et al., and 4,464,292, issued Aug. 7, 1984 to Lengyel, disclose detergent compositions comprising an ethoxylated alcohol and an ethoxy sulfate as a combination of nonionic and anionic surfactants, and over 70 wt % of anhydrous sodium carbonate (soda ash) as a detergent builder.

U.S. Patent No. 4,490,271, issued Dec. 25, 1984 to Spadini et al., discloses detergent compositions comprising an active surfactant, up to 80% of a non-phosphorus detergent builder such as a water-soluble carbonate, and a polyacrylate such as a copolymer of acrylic acid with any of various comonomers.

U.S. Pat. No. 4,521,332, issued Jun. 4, 1985 to Milora, discloses highly alkaline liquid cleaning compositions comprising a nonionic surfactant, 10 to 45 wt. % of sodium hydroxide, 0.04 to 4 wt. % of a polyacrylic acid salt, 0 to 15 wt. % of an alkali metal phosphate builder such as STPP, 0.5 to 20 wt. % of a "building agent" such as sodium carbonate, and 6 to 60 wt. % of water.

U.S. Pat. No. 4,711,740, issued Dec. 8, 1987 to Carter et al., discloses detergent compositions comprising a "detergent active" compound, i.e., a surfactant, a detergent builder which is a water-soluble carbonate, e.g. sodium carbonate in an amount of "at least 5% by weight, such as from 10% to 40%, preferably 10% to 30% weight, though an amount up to 75% could possible be used if desired in special products," a water insoluble carbonate, e.g., calcium carbonate (calcite) in an amount of 5 to 60 wt. %, as seed crystals for precipitated calcium carbonate which is thus prevented from being deposited on fabrics; and a copolymer of a carboxylic monomer, e.g., acrylic acid, and a non-carboxylic monomer, such copolymer being present in an amount of 0.1 to 10 wt. % and acting as a colloid stabilizer for the precipitated calcium carbonate. Other detergency builders such as STPP may also be present.

U.S. Pat. No. 4,820,441, issued Apr. 11, 1989 to Evans et al., discloses granular detergent compositions which may contain in addition to an active surfactant, 5 to 75 wt. % of a crystal growth modified, carbonate-based structurant salt, 0.1 to 20 wt. % of a polymeric polycarboxylate as crystal growth modifier based on the weight of the structurant salt, and 0 to 40 wt. % of STPP. The structurant salt may contain sodium sulfate as well as sodium carbonate and sodium bicarbonate, and the two tables under the heading "PRODUCTS OF THE INVENTION" in columns 8 and 9 of the patent show a maximum of 40 wt. % of sodium carbonate in the final product composition.

U.S. Pat. No. 4,849,125, issued Jul. 18, 1989 to Seiter et al., discloses phosphate-reduced, granular, free-flowing detergent compositions comprising 4 to 40 wt. % of a nonionic surfactant, 3 to 20 wt. % of an anionic surfactant, 0.5 to 15 wt. % of a homopolymeric or copolymeric carboxylic acid or salt, 0 to 20 wt. % of STPP, and, optionally, up to 15 or 20 wt. % of sodium carbonate.

M. E. McLester et al., "Effects of Alkaline-Earth Metals on the Transformation of Aragonite to Calcite in Aqueous Solution", Journal of Inorganic Nuclear Chemistry 32 (1970), 391–399, discusses the influence of strontium ions in solution on the transformation of aragonite to calcite in a heterogeneous system of solids.

SUMMARY OF THE INVENTION

In accordance with this invention a laundry detergent composition is provided wherein the solids content comprises an active surfactant, at least about 70 wt. % of a water-soluble alkaline carbonate, and a minor amount of elemental strontium in the form of a water soluble salt, which has the effect of reducing fabric encrustation. Optionally, the composition may also contain a minor amount of a polymeric polycarboxylate, which further reduces encrustation to an unexpected degree. The term "polymeric polycarboxylate" includes homopolymers of monoethylenically unsaturated carboxylic acids and copolymers of such acids as hereinafter defined.

Incorporation of strontium ions in the foregoing laundry detergent composition containing carbonate ions is intended to preserve all the advantages of high carbonate content while minimizing negative interactions that will occur between the precipitation of calcium carbonate and the surfaces of the fabric being cleaned. For example, the composition is capable of providing excellent cleaning and whitening of fabrics while avoiding the problem of eutrophication which occurs when a substantial amount of a phosphorous containing builder such as STPP is present in the composition, and while minimizing the problem of fabric encrustation often present when the composition contains a large amount of carbonate builder.

The reduction in the amount of fabric encrustation when using the laundry detergent composition of this invention is apparently partly due to an effect of strontium ions at certain concentrations in inhibiting the precipitation of calcium carbonate on the substrate being cleaned, i.e., fabric surfaces, with an enhancement of this effect when a polymeric polycarboxylate is also present. This is a surprising effect since strontium is a member of the alkaline earth group of metals together with calcium which is the main hardness ingredient of water. Furthermore the enhancement in the reduction of encrustation caused by the combination of polymeric polycarboxylate with strontium is also surprising since such polycarboxylate is conventionally used in detergent compositions to prevent encrustation by calcium hardness.

DETAILED DESCRIPTION OF THE INVENTION

The water-soluble alkaline carbonate may be, for example, an alkali metal carbonate, bicarbonate or sesquicarbonate, preferably sodium or potassium carbonate, bicarbonate or sesquicarbonate, and most preferably sodium carbonate. A combination of more than one of such compounds may be used, e.g., sodium carbonate and sodium bicarbonate. The total water-soluble alkaline carbonate may be present in an amount, for example, of about 70 to 90 wt. %, preferably about 75 to 85 wt. %, based on the weight of the solids. If a combination of alkali metal carbonate and bicarbonate is used as the water-soluble carbonate, then the alkali metal carbonate, e.g., sodium carbonate, is preferably used in an amount of about 75 to 80 wt. % and the alkali metal bicarbonate, e.g., sodium bicarbonate, in an amount of about 0.1 to 15 wt. %.

Water soluble strontium salts which may be used in preparing the detergent compositions of this invention are, for example, strontium chloride, Strontium nitrate, and strontium acetate. Sufficient strontium salt is added to the composition such that elemental strontium is present in an amount, for example, of up to about 12 wt. % based on the total solids. In general, the wash water before the addition of cleaning composition contains a calcium hardness of for example, about 10 to 450 ppm of calcium hardness expressed as $CaCO_3$ and a Ca/Mg molar ratio of, for example, about 5/1 to 2/1 may be present, in which case the elemental strontium in the detergent composition should be, for example, about 0.1 to 12 wt. %, preferably about 1 to 5 wt. % based on the weight of total solids in the composition. The foregoing ranges of amount of strontium in the detergent composition and the calcium and magnesium content of the wash water assume normal and accepted use of a detergent wherein the wash liquor contains about 0.1 to 1 wt. % of detergent solids during the washing operation.

The active surfactant component may be, for example, one or more of many suitable synthetic detergent active compounds which are commercially available and described in the literature, e g , in "Surface Active Agents and Detergents", Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the composition may include a synthetic anionic, nonionic, amphoteric or zwitterionic detergent active compound, or mixtures of two or more of such compounds.

More preferably, the laundry detergent compositions of this invention contain at least one anionic or nonionic surfactant, and, most preferably, a mixture of the two types of surfactant.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkylbenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$–$C_{18}$, preferably $C_{12}$–$C_{16}$, alkyl groups and, if ethoxylated, on average about 1–15, preferably 3–12 moles of ethylene oxide (EO) per mole of alcohol, and sulfated ethoxylated alkylphenols with $C_8$–$C_{16}$ alkyl groups, preferably $C_8$–$C_9$ alkyl groups, and on average from 4–12 moles of EO per mole of alkyl phenol.

The preferred class of anionic surfactants are the sulfated ethoxylated linear alcohols, such as the $C_{12}$–$C_{16}$ alcohols ethoxylated with an average of from about 1 to about 12 moles of ethylene oxide per mole of alcohol. A most preferred sulfated ethoxylated surfactant is made by sulfating a $C_{12}$–$C_{15}$ alcohol ethoxylated with 3 moles of ethylene oxide per mole of alcohol.

Specific nonionic surfactants which can be used in the compositions of the present invention include ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles of EO per mole of alkyl phenol.

The preferred class of nonionic surfactants are the ethoxylated linear alcohols, such as the $C_{112}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 3 moles of ethylene oxide per mole of alcohol.

Mixtures of the foregoing synthetic detergent type of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to 15 wt. % preferably about 8 to 12 wt. % based on the weight of solids in the composition. If, as preferred, the active surfactant consists of a combination of anionic and nonionic surfactants, then the anionic surfactant is present in the range, for example, of about 4 to 14 wt. %, preferably about 5 to 10 wt. %, and the nonionic surfactant is present in the range, for example, of about 2 to 8 wt. %, preferably about 3 to 5 wt. %, all based on the weight of total solids.

If a polymeric polycarboxylate is employed in the composition, it may be, for example, a homopolymer or copolymer (composed of two or more co-monomers) of an alpha, beta-ethylenically unsaturated acid monomer such as acrylic acid, methacrylic acid, a diacid such as maleic acid, itaconic acid, fumaric acid, mesoconic acid, citraconic acid and the like, a monoester of a diacid with an alkanol, e.g., having 1–8 carbon atoms, and mixtures thereof. When the polymeric polycarboxylate is a copolymer, it may be a copolymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which may be either relatively nonpolar such as styrene or an olefinic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., copolymers of acrylic acid and acrylamide by partially hydrolyzing a polyacrylamide.

Copolymers of at least one unsaturated carboxylic acid monomer with at least one non-carboxylic comonomer should contain at least about 50 mol % of polymerized carboxylic acid monomer.

The polymeric polycarboxylate should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions, or with magnesium ions supplied by magnesium oxide or hydroxide which thus acts as the source of the added magnesium.

The polymeric polycarboxylate may be present in the detergent composition in an amount, for example, of about 0.05 to 5 wt. %, preferably about 0.1 to 2 wt. %, based on the weight of the total solids.

In addition to its usual function as a soil antiredeposition agent, the polymeric polycarboxylate has the effect in this invention of enhancing the reduction of encrustation caused by the added strontium to a greater than expected degree. Thus, in the absence of polymeric polycarboxylate, the added strontium of this invention has the effect of reducing somewhat fabric encrustation for wash cycle times of about 12 minutes. However, in the presence of a polymeric polycarboxylate, the addition of strontium reduces encrustation to a degree considerably greater than the added strontium alone, or of the polymeric polycarboxylate alone.

The detergent composition of this invention is preferably in the form of a dry-appearing powder, in which case the weight percentages of the various components mentioned previously are approximately based on the weight of the total composition. However, such dry appearing powder generally contains water in an amount, for example, of about 1 to 12 wt. %, preferably about 2 to 10 wt % based on the weight of the total composition. Alternatively, however, the detergent composition may be in the form of a liquid, e.g., a concentrated aqueous solution of the detergent components containing, for example, about 0.5 to 30 wt. % of detergent solids.

The laundry detergent compositions of this invention may also contain various adjuvants common to detergent formulations such as brighteners, enzymes, carboxymethylcellulose, perfumes, dyes and peroxide generating persalts.

The following examples further illustrate the invention.

EXAMPLE 1 AND 2 and COMPARATIVE EXAMPLES A AND B

These examples illustrate the effects in reducing fabric encrustation of the presence in a standard detergent formulation of strontium and a polymeric polycarboxylate each separately and when used together.

In each of these examples, encrustation determinations were carried out using cleaning formulations comprising a base detergent composition consisting of, by weight, 80 parts of sodium carbonate, 0.5 parts of sodium bicarbonate, an active surfactant consisting of 6.0 parts of the sodium salt of a sulfated $C_{12}$–$C_{15}$ alcohol (anionic surfactant) and 3.2 parts of a $C_{12}$–$C_{15}$ alcohol ethoxylated with 3 moles of ethylene oxide per mole of alcohol (nonionic surfactant), about 8.8 parts of water, and wash water containing 250 ppm of calcium and magnesium hardness as $CaCO_3$ with a Ca/Mg molar ratio of 2/1. In comparative Example A the formulation was tested as is without the addition of any other components. In Comparative Example B the formulation consisted of the base detergent composition plus about 1.35 wt. % of Rohm & Haas 445 polymer, which is a polyacrylic acid having a number average molecular weight of about 4500. The polymer becomes completely neutralized on contact with the sodium carbonate of the formulation. In Example 1 the formulation consisted of the base detergent composition plus about 3.9 wt. % of strontium chloride ($SrCl_2$) which is equivalent to about 2.1 wt. % of elemental strontium. In Example 2, the formulation consisted of the base detergent composition plus both additional components, viz., 1.35 wt. % of Rohm and Haas 445 polymer and about 3.9 wt. % of strontium chloride. The four detergent compositions were tested for fabric encrustation by repeated washing of cotton fabric at 35° C. In carrying out each test, four 25.4 cm.×25.4 cm., 100% black cotton fabric swatches along with 0.907 kg. of ballast are washed for 12 min. with 113.4 g of the detergent composition being tested such that the wash liquor contained about 0.162 wt. % of detergent After washing is completed, 2.00–4.00 g of the calcium carbonate encrusted fabrics are extracted in 100 ml. of 0.2N hydrochloric acid for 30 min. and a 2.0–4.0 ml. aliquot is analyzed for hardness by the EDTA titration method. Encrustation is expressed as mg. calcium carbonate per gram of fabric obtained after five machine cycles of use. The results are shown in Table I.

TABLE 1

| Example | 445 Polymer wt. % | $SrCl_2$, wt. % | Encrustation, mg. $CaCO_3$/g fabric |
|---|---|---|---|
| A | 0 | 0 | 103 |
| B | 1.35 | 0 | 76 |
| 1 | 0 | 3.9 | 75 |
| 2 | 1.35 | 3.9 | 9 |

The results of Table I show that the presence of strontium in the form of a dissolved salt in the absence of a polymeric polycarboxylate unexpectedly reduces fabric encrustation to about the same extent as the presence of a polymeric polycarboxylate in the absence of strontium, and that the presence of both strontium and polymeric polycarboxylate reduces the encrustation still further to a degree which could not be predicted from the separate effects of the strontium and polymer, i.e., use of the two additives together results in a synergistic effect in reduction of encrustation.

We claim:

1. A laundry detergent composition wherein the solids content comprises an active surfactant, at least about 70 wt. % of an alkali metal carbonate, and a minor amount of elemental strontium in the form of a water soluble inorganic salt.

2. The composition of claim 1 wherein said alkali metal carbonate is sodium or potassium carbonate.

3. The composition of claim 2 wherein said alkali metal carbonate is sodium carbonate.

4. The composition of claim 1 comprising about 75 to 80 wt. % of sodium carbonate and about 0.1 to 15 wt. % of sodium bicarbonate.

5. The composition of claim 1 wherein said elemental strontium comprises about 0 1 to 12 wt. % of the total solids.

6. The composition of claim 5 wherein said elemental strontium comprises about 1 to 5 wt. % of the total solids.

7. The composition of claim 1 wherein said strontium salt is strontium chloride.

8. The composition of claim 1 wherein said anionic surfactant is an alkali metal salt of sulfated linear $C_{12}$–$C_{16}$ alcohols ethoxylated with an average of 1 to 12 moles of ethylene oxide per mole of alcohol and is present in an amount of about 4 to 14 wt. %, and said nonionic surfactant consists of $C_{12}$–$C_{16}$ linear alcohols ethoxylated with an average of 1 to 12 moles of ethylene oxide per mole of alcohol and is present in an amount of about 2 to 8 wt. % based on the weight of total solids.

9. The composition of claim 1 also containing a minor amount of a polymeric polycarboxylate.

10. The composition of claim 9 containing about 0.05 to 5 wt. % of a polymeric polycarboxylate, based on the weight of the solids.

11. The composition of claim 9 wherein said polymeric polycarboxylate is an acrylic acid polymer.

12. The composition of claim 1 in the form of a dry-appearing powder containing about 1 to 12 wt. % of water.

13. A process comprising washing a fabric with the composition of claim 1.

14. The composition of claim 1 wherein said strontium salt is strontium chloride, strontium nitrate, or strontium acetate.

* * * * *